US006818105B2

(12) United States Patent
Tojo et al.

(10) Patent No.: US 6,818,105 B2
(45) Date of Patent: Nov. 16, 2004

(54) APPARATUS FOR GENERATING FLUORINE GAS

(75) Inventors: Tetsuro Tojo, Kagawa (JP); Jiro Hiraiwa, Kagawa (JP); Hitoshi Takebayashi, Kagawa (JP); Yoshitomi Tada, Kagawa (JP)

(73) Assignee: Toyo Tanso Co., Ltd., Osaka (JP)

( * ) Notice: Subject to any disclaimer, the term of this patent is extended or adjusted under 35 U.S.C. 154(b) by 143 days.

(21) Appl. No.: 10/240,722

(22) PCT Filed: Apr. 6, 2001

(86) PCT No.: PCT/JP01/02976

§ 371 (c)(1),
(2), (4) Date: Oct. 7, 2002

(87) PCT Pub. No.: WO01/77412

PCT Pub. Date: Oct. 18, 2001

(65) Prior Publication Data

US 2003/0047445 A1 Mar. 13, 2003

(30) Foreign Application Priority Data

Apr. 7, 2000 (JP) ..... 2000-111929
Mar. 15, 2001 (JP) ..... 2001-74043

(51) Int. Cl.[7] ..... C25B 15/00; C25C 3/00

(52) U.S. Cl. ..... 204/240; 204/246; 204/247; 204/264; 204/292

(58) Field of Search ..... 204/243.1, 245–247, 204/240, 264, 292; 205/619

(56) References Cited

U.S. PATENT DOCUMENTS 4,511,440 A * 4/1985 Saprokhin et al. ..... 205/411
5,084,156 A * 1/1992 Iwanaga et al. ..... 204/247
5,290,413 A * 3/1994 Bauer et al. ..... 204/243.1
5,688,384 A * 11/1997 Hodgson et al. ..... 204/228.2
6,146,506 A * 11/2000 Bauer et al. ..... 204/247

FOREIGN PATENT DOCUMENTS

| | | |
|---|---|---|
| JP | 56-127781 | 10/1981 |
| JP | 63-130789 | 6/1988 |
| JP | 2-232386 | 9/1990 |
| JP | 3-53090 | 3/1991 |
| JP | 6-88267 | 3/1994 |
| JP | 9-143779 | 6/1997 |
| JP | 9-176885 | 7/1997 |
| JP | 2000-313981 | 11/2000 |

* cited by examiner

*Primary Examiner*—Donald R. Valentine
(74) *Attorney, Agent, or Firm*—Oblon, Spivak, McClelland, Maier & Neustadt, P.C.

(57) ABSTRACT

A fluorine gas generating apparatus for generating fluorine gas of high purity by electrolysis of a mixed molten-salt comprising hydrogen fluoride, the fluorine gas generating apparatus comprising an electrolytic cell which is separated into an anode chamber 5 and a cathode chamber 7 by a partition wall 28, and pressure keeping means 50 for supplying gas to the anode chamber 5 and the cathode chamber 7, respectively, to keep an interior of the anode chamber 5 and an interior of the cathode chamber 7 at a certain pressure.

27 Claims, 9 Drawing Sheets

APPARATUS FOR GENERATING FLUORINE GAS

TECHNICAL FIELD

The present invention relates to a fluorine gas generating apparatus, and more particularly, to a fluorine gas generating apparatus for producing high purity fluorine gas extremely low in impurity content for the manufacturing process of semiconductors and the like, in particular.

BACKGROUND

Fluorine gas has been used hitherto as an essential gas in the semiconductor manufacturing field, for example. While the fluorine gas may be used alone, the demand for nitrogen trifluoride gas (hereinafter it is called $NF_3$ gas) synthetically prepared based on the fluorine gas, for the use as a semiconductor cleaning gas or a dry etching gas has been rapidly increased. Neon fluorine gas (hereinafter it is called NeF gas), Argon fluoride gas (hereinafter it is called ArF gas), Krypton fluoride gas (hereinafter it is called KrF gas) and the like are excimer laser oscillation gases used for patterning of a semiconductor integrated circuit. Mixed gas of noble gas and fluorine gas is very often used as raw material of the excimer laser oscillation gas.

The fluorine gas and the $NF_3$ gas used for manufacturing semiconductors and the like are required to be high purity gas containing minute amounts of impurities. In the manufacturing site of semiconductor and the like, it is a common usage that a necessary amount of gas is taken out of a gas container filled with the fluorine gas. Accordingly, it is very important to pay attention to the place to keep the gas cylinder, the assurance of the safety of gas and the preservation of the purity of gas. Further, as the demand for the $NF_3$ gas has been rapidly increased recently, the problem occurs with the supply-side, thus arising the problem that some stock must be backlogged. When considering these problems, it is preferable to place an on-demand or on-site fluorine gas generating apparatus in the location to use it, rather than to treat a high-pressure fluorine gas.

The fluorine gas is usually produced in an electrolytic cell as shown in FIG. 9. Ni, monel, carbon steel and the like are usually used as material of an electrolytic cell body 201. Further, a base plate 212 formed of polytetrafluoroethylene and the like is attached to the bottom of the cell, to prevent hydrogen gas generated and fluorine gas from being mixed with each other. Mixed molten-salt of potassium fluoride-hydrogen fluoride series (hereinafter it is called KF—HF systems) is filled in the electrolytic cell body 201 in the form of an electrolytic bath 202. The electrolytic cell body is separated into an anode chamber 210 and a cathode chamber 211 by a skirt 209 formed of monel and the like. By the application of a voltage between a carbon or nickel (hereinafter it is called Ni) anode 203 contained in the anode chamber 210 and a Ni cathode 204 contained in the cathode chamber 211, the fluorine gas is produced electrolytically. The fluorine gas produced is discharged from a generation port 208 and the hydrogen gas produced at the cathode side is discharged from a hydrogen gas discharge port 207. However, since carbon tetrafluoride gas (hereinafter it is called $CF_4$ gas) produced and hydrogen fluoride gas (hereinafter it is called HF gas) evaporated from the electrolytic bath and the like during the electrolysis come to be mixed in the fluorine gas, it is hard to obtain the fluorine gas of high purity.

Therefore, it is the object to the present invention to provide a fluorine gas generating apparatus that can produce high purity fluorine gas stably.

DISCLOSURE OF THE INVENTION

To solve the problems mentioned above, the present invention provides a fluorine gas generating apparatus for generating fluorine gas of high purity by electrolysis of a mixed molten-salt comprising hydrogen fluoride, the fluorine gas generating apparatus comprising an electrolytic cell which is separated into an anode chamber and a cathode chamber by a partition wall, and pressure keeping means for supplying gas to the anode chamber and the cathode chamber, respectively, to keep an interior of the anode chamber and an interior of the cathode chamber at a certain pressure.

The pressure keeping means permits the anode chamber and the cathode chamber to be always kept at a constant pressure. This permits quick realization of a prescribed concentration and rate of flow of fluorine by introduction of a noble gas of a carrier gas to the fluorine gas. Particularly, this can put the gas in the usable condition quickly from the start up of electrolytic cell. Also, since the interior of the anode chamber and the interior of the cathode chamber are kept at a certain pressure, the prevention of the air and the like from coming into the chambers from outside can be provided, and as such can permit the fluorine gas of high purity to be generated stably. It should be noted that the phrase of "being kept at a certain pressure" as referred to in the present invention is intended to include the condition of no differential pressure between the internal environment and the external environment (e.g. the use under atmospheric pressure).

The present invention provides a fluorine gas generating apparatus for generating fluorine gas of high purity by electrolysis of a mixed molten-salt comprising hydrogen fluoride, the fluorine gas generating apparatus comprising an electrolytic cell which is separated into an anode chamber and a cathode chamber by a partition wall, pressure keeping means for supplying gas to the anode chamber and the cathode chamber, respectively, to keep an interior of the anode chamber and an interior of the cathode chamber at a certain pressure, a cabinet in which the electrolytic cell is contained and which can provide a controlled atmosphere, and a filter, contained in the cabinet, for filtering out particles in the fluorine gas generated from the electrolytic cell.

This can provide controlled atmosphere around the electrolytic cell, and as such can surely prevent carbon dioxide gas and the like from coming into the electrolytic cell. As a result of this, the generation of $CF_4$ gas produced by reaction of the fluorine gas with the carbon dioxide gas can be suppressed to obtain the fluorine gas of high purity. Also, even if leakage of the fluorine gas from the electrolytic cell occurs, there is no fear of the fluorine gas being leaked outside. In addition, the particles produced by the entrainment from the electrolytic bath during the electrolysis can be surely filtered out by the filter. It is to be noted that the filter preferably has corrosion resistance against the fluorine gas. For example, sintered monel, sintered Hastelloy and the like can be used for the filter. The cabinet for containing the electrolytic cell preferably has corrosion resistance against the fluorine gas. The cabinet is preferably formed, for example, of metal such as carbon steel or polyvinyl chloride.

In the fluorine gas generating apparatus of the present invention, at least one of the anode chamber and the cathode chamber of the electrolytic cell is provided with liquid level detecting means for detecting an upper level and a lower level of liquid level fluctuation of the molten-salt.

This permits the liquid level of the electrolytic bath contained in the electrolytic cell to be grasped even when the interior of the electrolytic cell cannot be visually inspected. This permits the electrolytic bath to be constantly kept at a constant liquid level, and as such can prevent possible back flow of the electrolytic bath. By association of the liquid level detecting means and the power source control means for the electrodes, the electrolysis can be halted whenever the abnormal liquid level of the electrolytic bath is detected.

In the fluorine gas generating apparatus of the present invention, the pressure keeping means is provided with a solenoid valve that is opened and closed based on detection results of the liquid level detecting mean, so as to supply or discharge the gas to and from the interior of the anode chamber and the interior of the cathode chamber.

This permits the automatic supply or discharge of the gas to and from the interior of the anode chamber and/or the interior of the cathode chamber based on the detection results of the liquid level detecting means to detect the liquid level of the electrolytic bath. This enables the liquid level of the electrolytic bath to be always kept at a constant level, and as such can permit the stable generation of the fluorine gas.

In the fluorine gas generating apparatus of the present invention, the mixed molten-salt comprising the hydrogen fluoride is KF—HF systems and there is provided temperature control means for adjusting temperature of the mixed molten-salt comprising the hydrogen fluoride.

This permits the temperature of the mixed molten-salt in the electrolytic cell during the electrolysis to be always kept at a constant temperature, and as such can permit the fluorine gas to be generated efficiently.

In the fluorine gas generating apparatus of the present invention, the gas supplied by the pressure keeping means is a noble gas.

When the generated gas is diluted, for example, with neon gas (Ne gas), argon gas (Ar gas), krypton gas (Kr gas) and the like, that diluted gas can be used as a mixed gas of any selective mixture ratio, and as such can allow the mixed gas to be used as an excimer laser oscillation gas used for patterning of the semiconductor integrated circuits.

In the fluorine gas generating apparatus of the present invention, an anode and a cathode disposed in the anode chamber and the cathode chamber respectively are formed of nickel.

The use of Ni for the anode can prevent drop of the carbon grains caused by the electrolysis using the carbon electrodes. This can prevent the mixture of $CF_4$ by reaction with carbon and fluorine gas, and as such can permit the production of high purity fluorine gas. In addition, this can also prevent the occurrence of the anode effect that is a polarization phenomenon that is typical of the carbon electrode. Further, the use of Ni for the cathode can permit the surface energy to be reduced by hydride and oxide generated on the surface of Ni, as compared with the iron cathode. This permits the bubbles of the hydrogen gas generated to become so large that the mixture with the fluorine gas can be prevented. Also, this can permit the distance between the anode and the cathode to be reduced, and as such can permit the electrolytic cell to be reduced in size.

In the fluorine gas generating apparatus of the present invention, the electrolytic cell is formed of metal.

When the metal having high strength and high airtightness, such as Ni, monel, pure iron, and stainless steel, is used for the electrolytic cell body and the coupling, leakage of gas from the electrolytic cell can be prevented. For example, even when the interior of the electrolytic cell is in a helium gas atmosphere under a pressure higher than the atmospheric pressure by 0.1 MPa, leakage of helium gas can be prevented.

In the fluorine gas generating apparatus of the present invention, the electrolytic cell is cylindrical in shape.

This permits the electrolytic cell to be heated uniformly from around the circumference by the temperature control means. Also, since the electrodes are disposed concentrically, the current distribution can be made uniform over the electrolytic cell, and as such can permit the stable electrolysis.

In the fluorine gas generating apparatus of the present invention, the electrolytic cell is formed of metal and serves as a cathode.

Since the electrolytic cell can serve as the cathode, there is no need to additionally provide the cathode and, as a result of this, the electrolytic cell can be reduced in size. This enables the fluorine gas generating apparatus to be set at any selective location. As a result of this, the fluorine gas generating apparatus is located at any necessary location on a production line in the semiconductor manufacturing process, namely, is set on an on-site basis.

In the fluorine gas generating apparatus of the present invention, the electrolytic cell is formed of metal; formed in a cylindrical shape; and serves as the cathode.

This permits the electrolytic cell to be heated uniformly from around the circumference by the temperature control means. Also, since the electrodes are disposed concentrically, the current distribution can be made uniform over the electrolytic cell, and as such can permit the stable electrolysis. Further, since the electrolytic cell can serve as the cathode, there is no need to additionally provide the cathode and, as a result of this, the electrolytic cell can be reduced in size.

In the fluorine gas generating apparatus of the present invention, the electrolytic cell is formed of a resin having corrosion resistance against the fluorine gas.

Since the electrolytic cell is formed of the resin having corrosion resistance against the fluorine gas, the electrolytic cell comes to be hard to be corroded by the fluorine gas generated. Particularly, when a little amount of fluorine gas is generated, the electrolytic cell is hardly corroded. It is to be noted here that the structural materials that may be used for the electrolytic cell include fluoropolymer having corrosion resistance against the fluorine gas, such as polytetrafluoroethylene resin, and tetrafluoroethylene/perfluoroalkyl vinyl ether copolymer, trimethylpentene resin and equivalent.

In the fluorine gas generating apparatus of the present invention, the electrolytic cell is formed of a resin having corrosion resistance against the fluorine gas and is formed in a rectangular cylindrical shape.

This can provide improved mechanical strength even when the electrolytic cell is formed of resin.

In the fluorine gas generating apparatus of the present invention, the electrolytic cell is formed of a resin having corrosion resistance against the fluorine gas and is formed in a rectangular cylindrical shape, and at least one side surface of the electrolytic cell is threadedly engaged with the electrolytic cell so as to be freely opened and closed.

This can permit the facilitation of replacement of the electrodes, and the mixed molten-salt in the electrode and the electrolytic cell and of the electrodes. The threaded engagement of one side surface can provide improved airtightness and improved strength of the electrolytic cell.

In the fluorine gas generating apparatus of the present invention, the electrolytic cell is formed of a resin having corrosion resistance against the fluorine gas and is formed in a rectangular cylindrical shape, and at least one side surface of the electrolytic cell is formed of a transparent resin and the remaining side surfaces are formed of fluoropolymer.

This permits the visual inspection of the interior of the electrolytic cell during the electrolysis, as such can permit the visual inspection of an amount of sludge generated from the electrodes during the electrolysis even when Ni is used for the electrodes in the electrolytic cell. Also, this permits the visual inspection of the liquid level of the electrolytic bath during the electrolysis, as such can permit the control of the liquid level via the liquid level detecting means and the reliable grasping of the information about the liquid level.

In the fluorine gas generating apparatus of the present invention, there is provided a gas line in which the gas passing through the filter is pressured or de-pressured, and there are provided a pressurization apparatus or a depressurization apparatus and storage means in the gas line.

This enables the fluorine gas to be properly regulated to a predetermined pressure and also can prevent the liquid level fluctuation of the electrolytic bath caused by the pressure fluctuation of a reaction system via the pressure regulation valves, and as such can allow a required amount of fluorine gas to be supplied stably.

BEST MODE FOR CARRYING OUT THE INVENTION

In the following, an example of certain preferred embodiments of the present invention will be described with reference to the accompanying drawings.

Figure 1:
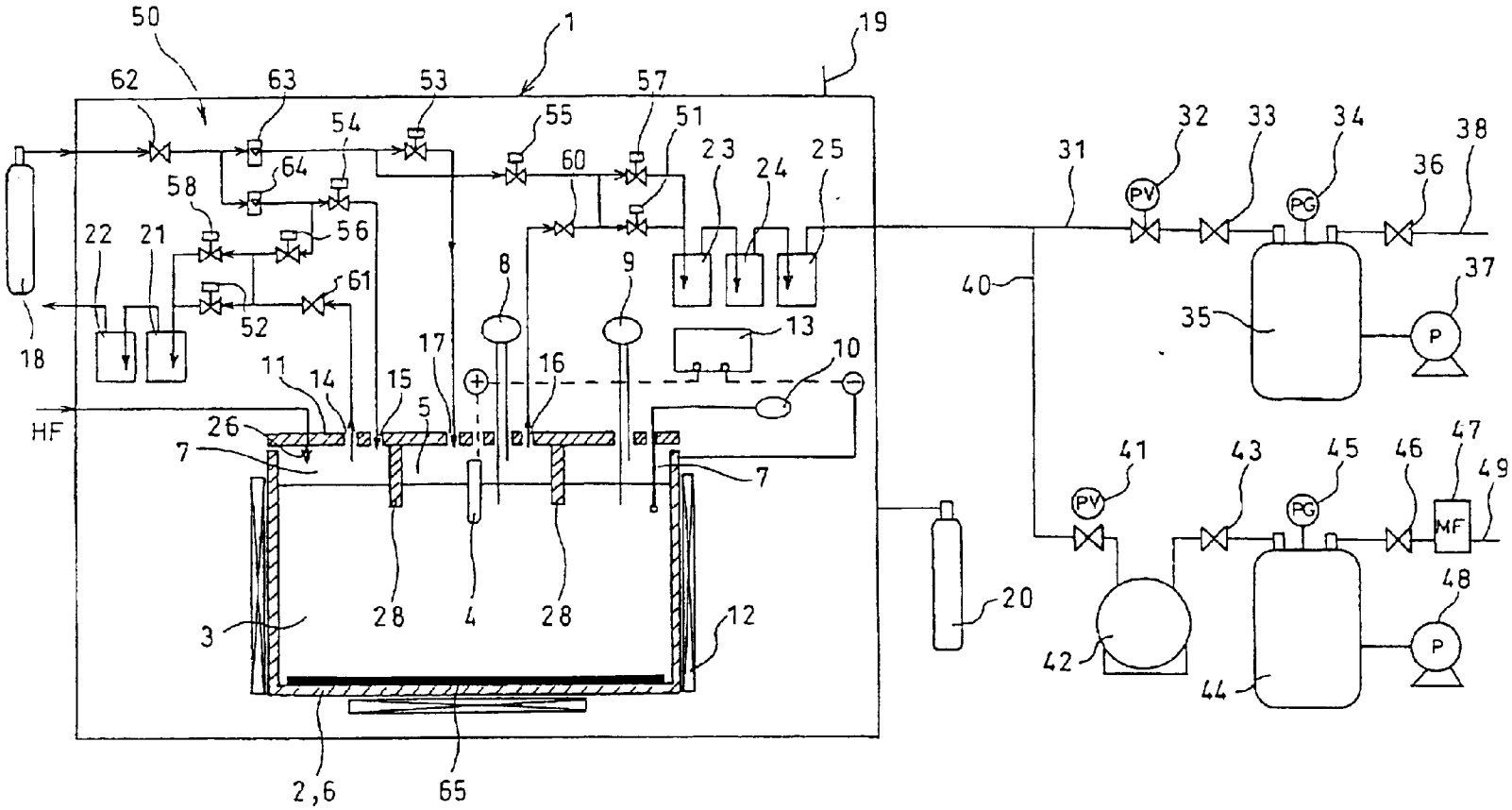
FIG. 1 is a schematic view of a fluorine gas generating apparatus of the present invention.

In FIG. 1, 1 denotes an atmosphere controllable cabinet, 2 denotes an electrolytic cell, 3 denotes an electrolytic bath comprising mixed molten salt of KF—HF systems, 4 denotes a Ni anode, 5 denotes an anode chamber, 7 denotes a cathode chamber, 8 denotes a level probe that is liquid level detecting means for detecting an abnormal liquid level of the anode chamber 5 caused by fluctuation of pressure, 9 denotes a level probe that is liquid level detecting means for detecting an abnormal liquid level of the cathode chamber 7 caused by fluctuation of pressure, 10 denotes temperature detecting means of the electrolytic bath, 20 denotes a cylinder that controls the atmosphere in the cabinet 1, 21 denotes a blank tower for storing the hydrogen gas generated from the cathode for a while, 22 denotes a 14F absorption tower filled with NaF and the like to eliminate Hf from the hydrogen gas, 23 denotes a blank tower for storing the fluorine gas generated from the anode for a while, 24 denotes a HF absorption tower filled with NaF and the like to eliminate HF from the fluorine gas, and 25 denotes a filter tower having a filter comprising sintered monel, sintered Hastelloy and the like for filtering out particles contained in the fluorine gas. The cabinet 1 is provided with gas lines 31, 40 to pressurize or depressurize the gas passing through the filter tower 25.

The electrolytic cell 2 is formed of metal, such as Ni, monel, pure iron, and stainless steel, and is integrally formed in a cylindrical shape. The electrolytic cell 2 is separated into the anode chamber 5 and the cathode chamber 7 by a partition wall 28 comprising Ni or monel. The anode 4 comprising Ni is disposed in the anode chamber 5. The electrolytic cell 2 itself forms the cathode 6. For this, a bottom plate 65 comprising polytetraplioroethylene and the like is attached to the electrolytic cell, in order to prevent the hydrogen gas generated from the cathode and the fluorine gas generated from the anode from being mixed with each other. Preferably, the distance between the anode 4 and the partition wall 28 and the distance between the partition wall 28 and a side wall of the electrolytic cell 2 is substantially equal to each other. This can suppress dissolution of the partition wall 28 caused by multipolarity, and as such can provide the effect of extending the life of the electrolytic cell 2. The anode 4 and the electrolytic cell 2 serving as the cathode 6 are connected to the power source13, so as to be energized. An upper lid 11 of the electrolytic cell 2 is provided with inlet and outlet ports 15, 17 for purge gas from a pressuring cylinder 18 which is pressure keeping means for pressuring the interior of the anode chamber 5 and the interior of the cathode chamber 7, a generation port 16 for the fluorine gas generated from the anode chamber 5, and a generation port 14 for the hydrogen gas generated from the cathode chamber 7. The electrolytic cell 2 is provided with temperature control means for heating the interior of the electrolytic cell 2. The temperature control means comprises a heater 12 provided around the body of the electrolytic cell 2 so as to be in close contact with it, a temperature control (not shown) to make a general PID control which is connected to the heater 12 and is set outside of the cabinet 1, and temperature detecting means 10, such as a thermocouple, disposed in either of the anode chamber 5 and the cathode chamber 7. The temperature control means serves to make a temperature control of the interior of the electrolytic cell 2. Heat insulating material is provided around the heater 12, though not shown. The heater 12 may take any form, including a ribbon type one and a heating element, and no particular limitation is imposed on the form of the heater 12. Preferably, the heater 12 has the form to surround the circumference of the electrolytic cell 2.

Ni is used for the anode 4. The use of Ni for the anode 4 can prevent the $CF_4$ gas from being mixed in the fluorine gas generated and also can produce no anode effect. In addition, since the electrolytic cell 2 is formed of metal, such as Ni, monel, pure iron and stainless steel, the electrolytic cell 2 can serve as the cathode 6. As a result of this, there is no need to additionally provide the cathode, thus providing a reduced size of the body of the electrolytic cell 2.

The anode chamber 5 and the cathode chamber 7 are provided with a pair of long-and-short level probes 8, 9, respectively, to detect the liquid level of the electrolytic bath 3. The level probes 8, 9 are connected with a power controller not shown and can serve to halt electrolysis at an upper permissible fluctuation limit of liquid level or a lower permissible fluctuation limit of liquid level. Though the pair of long-and-short level probes 8, 9 are preferably provided in both of the anode chamber 5 and the cathode chamber 7, they may be provide in either of them.

The pressure keeping means 50 to keep the pressure of the interior of the anode chamber 5 and the cathode chamber 7 at a level more than a certain level comprises solenoid valves 51, 52, 53, 54, 55, 56, 57, 58 which are opened and closed in accordance with the detection results obtained from the level probes 8, 9, so as to feed the gas into the electrolytic cell 2 or discharge the gas therefrom, manual valves 60, 61, 62 to open and close gas lines of the pressure keeping means 50, and flow meters 63, 64 to preset a flow rate of the gas passing through the gas lines at a predetermined flow rate. The pressure keeping means allows the pressure of the interior of the anode chamber 5 and the pressure of the interior of the cathode chamber 7 to be always kept at a higher level than an atmosphere pressure by not less than 0.01 MPa. As a result of this, the fluorine gas and the hydrogen gas produced electrolytically are discharged from their respective generation ports 16, 14 in such a fashion as to be extruded from the interior of the electrolytic cell 2. Thus, since the pressure keeping means keeps the pressure in the interior of the anode 5 and the pressure in the interior of the cathode 7 above a certain pressure level, the gases produced by electrolysis are allowed to be discharged from the electrolytic cell 2. In addition, since the pressure keeping means allows the pressure of the interior of the electrolytic cell 2 to be kept at a level somewhat higher than the atmosphere pressure, the ambient air is prevented from coming into the electrolytic cell 2.

No particular limitation is imposed on the gas filled in the pressuring cylinder 18, as long as it is an inert gas. For example, when at least one noble gas out of Ar gas, Ne gas, Kr gas, Xe gas and the like is used, a mixed gas of the fluorine gas and the at least one noble gas can be obtained easily in any selective mixture ratio. As a result of this, the mixed gas thus obtained can be used as e.g. an excimer laser oscillation source used for patterning of the semiconductor integrated circuits in the semiconductor manufacturing field. When the fluorine gas generating apparatus according to the present invention is located on a production line in the semiconductor manufacturing field, the fluorine gas can be properly supplied as needed on an on-site basis.

The blank towers 21, 23 serve to remove droplets from the electrolytic bath 3 contained in the fluorine gas and the hydrogen gas which are discharged from the anode chamber 5 and the cathode chamber 7, respectively, during the electrolysis. Accordingly, the blank towers are preferably formed of material having corrosion resistance against the fluorine gas and HF. For example, stainless steel, monel, Ni, fluoropolymers and the like can be cited.

The absorption towers 22, 24 contain NaF therein and serve to eliminate HF contained in the discharged fluorine gas or hydrogen gas therefrom. The absorption towers 22, 24 are preferably formed of material having corrosion resistance against the fluorine gas and HF, as is the case with the blank towers 21, 23. For example, stainless steel, monel, Ni, fluoropolymers and the like can be cited.

The filter tower 25 is located downstream from the absorption tower 24 and has in its interior a filter comprising sintered monel or sintered Hastelloy. When the fluorine gas passes through the filter, particles of the electrolytic bath 3 and complex of Ni and iron contained in the fluorine gas discharged from the anode chamber 5 can be filtered out.

The cabinet 1 containing these equipments and providing a controlled atmosphere is preferably formed of material that does not react with the fluorine gas. For example, metals such as stainless steel and resins such as vinyl chloride resin can be used. The cabinet 1 has an atmosphere controlling cylinder 20 and an exhaust opening 19, so as to provide a controlled atmosphere of the interior of the cabinet 1. This can provide a controlled atmosphere in the interior of the cabinet 1, and as such can produce the high purity fluorine gas. The cabinet 1 may be housed in a gas cylinder cabinet that is used in the semiconductor manufacturing facility and the like facility.

The pressurization line 40 connected with the cabinet 1 is provided with a pressure-regulation valve 41, a pressurizer 42, a buffer tank 44 that is a storage means, a pressure gauge 45, a flow meter with flow regulation function (hereinafter it is called the mass flow) 47, and a vacuum pump 48. The gas generated from the electrolytic cell 2 is pressurized by the pressurizer 42. The pressure-regulation valve 41 prevents the interior of the electrolytic cell 2 from being depressurized. The buffer tank 44 controls introduction and discharge of the gas thereinto and therefrom is controlled, together with the pressure gauge 45, valves 43, 46, and the mass flow 47. The fluorine gas is taken out from an outlet 49 when used.

The depressurization line 31 is provided with a pressure regulation valve 32, a buffer tank 35 that serves as storage means under reduced pressure, a pressure gauge 34, a vacuum pump 37 and others. The pressure of the buffer tank 35 is controlled by the vacuum pump 37 and is governed by use of the pressure gauge 34 and the valve 33 or 36, so as to control the introduction and discharge of the fluorine gas. The pressure regulation valve 32 prevents the interior of the electrolytic cell 2 from being depressurized. The fluorine gas is taken out from an outlet 38 when used. As mentioned above, according to the present invention, as a result of there being provided the storage means to store the fluorine gas generated by electrolysis, a desired amount of fluorine gas can be supplied therefrom as needed. This can provide the on-line fluorine gas generating apparatus that can be connected to the production line of the semiconductor manufacturing equipment. The depressurization line 31 or the pressurization line 40 may be property configured and arranged, and the configuration of the fluorine gas generating apparatus according to the present invention is not limited to the illustrated one. The line components, such as the pressurizer 42, the pressure regulation valves 41, 32 and the buffer tanks 35, 44, are preferably formed of material having corrosion resistance against the fluorine gas. The pressurizer 42 and the pressure regulation valves 41, 32 are preferably formed of Ni, and the buffer tanks 35, 44 and the lines are preferably formed of stainless steel. This can prevent the line components from being corroded by the fluorine gas.

Next, reference will be made to the state of the interior of the electrolytic cell 2 at the generation of the fluorine gas and to the operation of the pressure keeping means 50 with reference to FIGS. 2 to 6. It is to be noted that in the following drawing figures, the blackened valve shows the state in which the valve is opened and the gas is flowing, and the void valve shows the state in which the valve is closed and the gas is not flowing.

Figure 2:
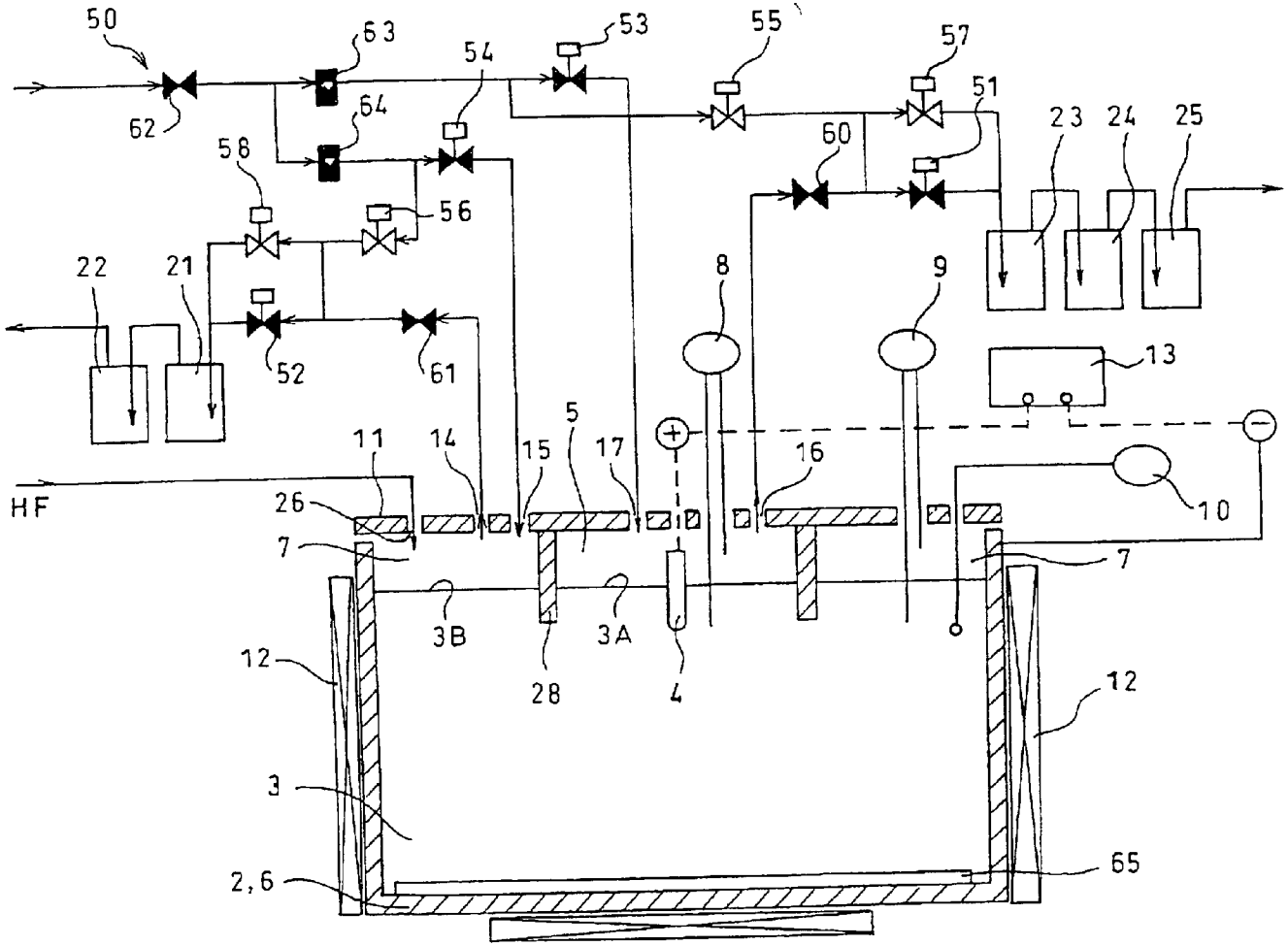
FIG. 2 is an illustration for explaining the relation between operation of pressure keeping means placed in an electrolytic cell and liquid level of an electrolytic bath of the electrolytic cell in an example of the embodiment of the fluorine gas generating apparatus according to the present invention.

FIG. 2 is an illustration showing the state of the electrolytic bath 3 in the electrolytic cell 2 and the open/close state of the valves of the pressure keeping means 50 when the electrolysis is normally proceeding. In FIG. 2, the blackened solenoid valves 51, 52, 53, 54, the blackened manual valves 60, 61, 62 and the blackened flow meters 63, 64 are all in the opened state and the gas is flowing on the line. With the flow rate of the gas adjusted by the flow meters 63, 64, the gas flows on the gas lines, while it is accompanied by a certain amount of carrier gas. As shown in FIG. 2, when the electrolysis is normally proceeding, the anode chamber 5 in the electrolytic cell 2 and the electrolytic bath 3 of the cathode chamber 7 are on a level with each other.

When the anode chamber 5 is increased in pressure or the cathode chamber 7 is decreased in pressure in the middle of electrolysis by the fluorine gas line being clogged, for example, resulting from accumulation of droplets of the electrolytic bath 3 and the like, so that the liquid level 3A of the electrolytic bath in the anode chamber 5 is lower than the liquid level 3B of the electrolytic bath in the cathode chamber 7, the abnormal liquid levels 3A, 3B are detected by the level probes 8, 9 provided in the anode chamber 5 and the cathode chamber 7, respectively.

Figure 3:
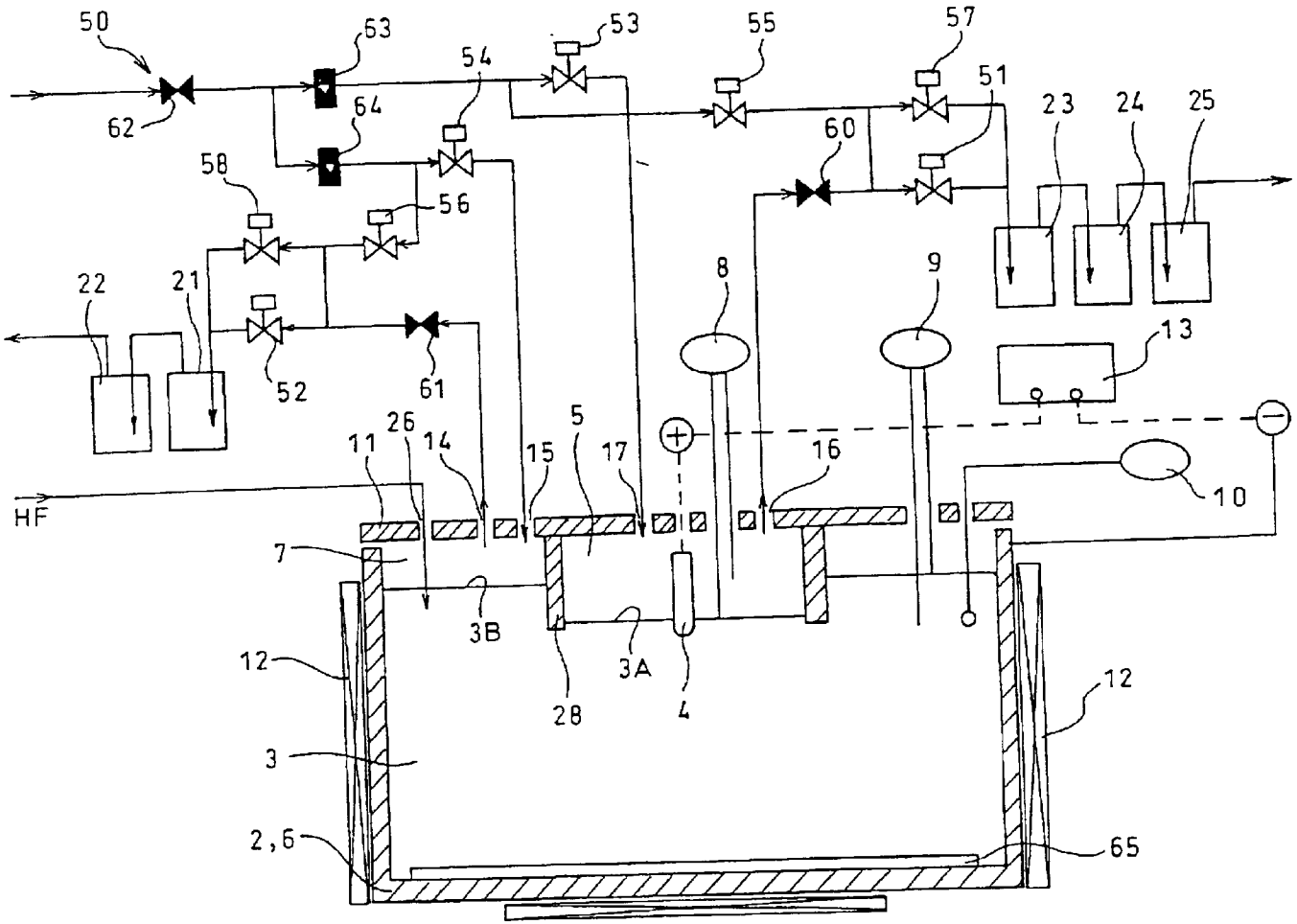
FIG. 3 is an illustration showing the state that a liquid level 3A of the electrolytic cell falls and a liquid level 3B of the electrolytic cell rises; the abnormal fall and rise of liquid level is detected by a level probe 8 or 9; and solenoid valves 51, 52, 53, 54 are closed.

Then, under control of the signals from the level probe 8 or 9, the solenoid valves 51, 52, 53, 54 are closed by control means (not shown) for controlling the solenoid valves 51, 52, 53, 54, 55, 56, 57, 58, as shown in FIG. 3, and thereby the gas flows are stopped. In parallel with this, under control of the signals from the control means, the power source 13 of the electrolysis is halted and thereby the electrolysis is halted.

Figure 4:
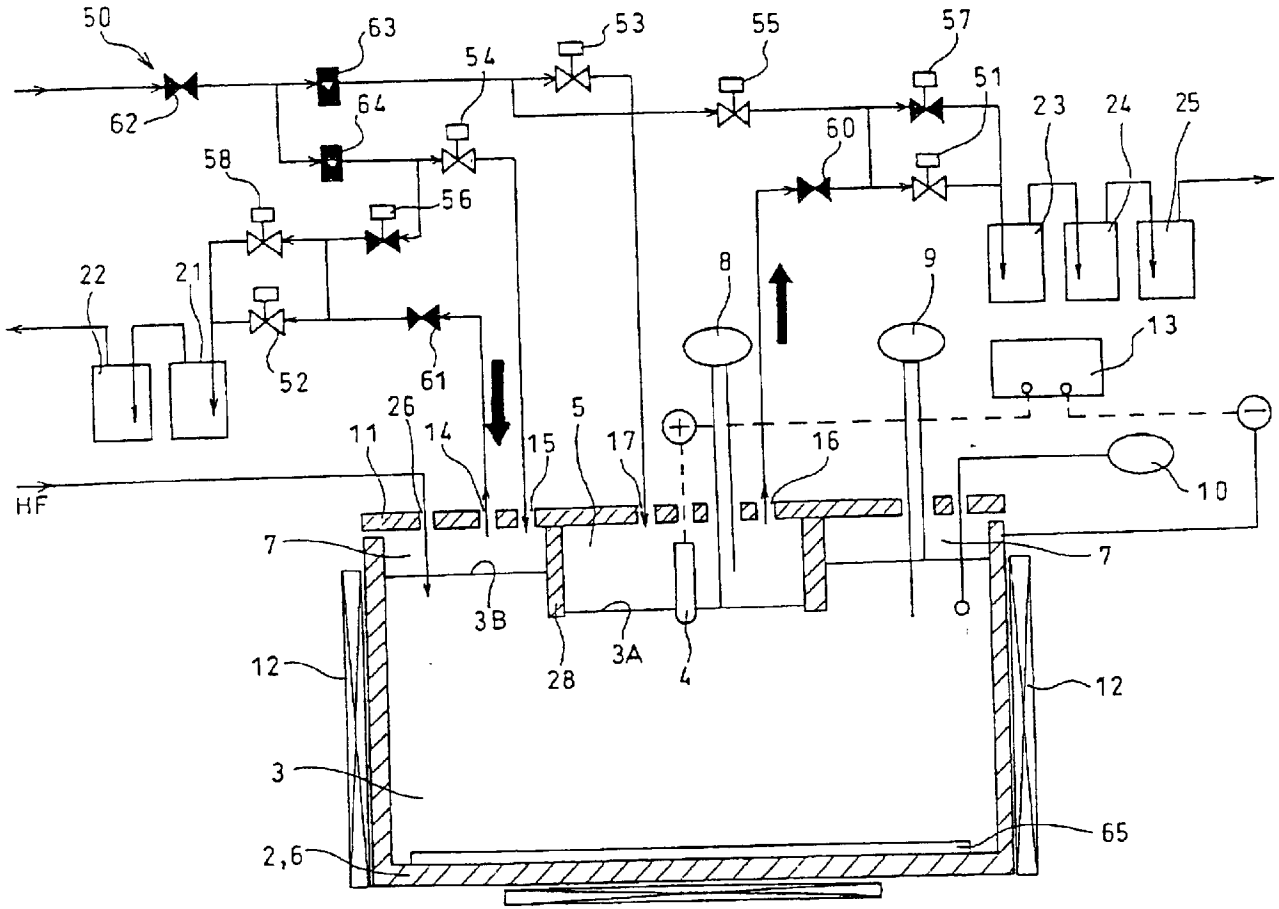
FIG. 4 is an illustration showing the state that following the state of FIG. 3, a solenoid valve 57 to discharge the gas of the anode chamber and a solenoid valve 56 to introduce the gas into the cathode chamber are opened to eliminate the abnormal liquid level.

When the electrolysis is halted, the solenoid valve 57 at the outlet side is opened for a short time, so that the fluorine gas in the interior of the anode chamber 5 is discharged from the fluorine gas generation port 16 provided in the upper lid 11 of the electrolytic cell 2. In parallel with this, the solenoid valve 56 is also opened for a short time, so that purge gas is introduced into the cathode chamber 7 through the hydrogen gas generation port 14. This state is shown in FIG. 4. After this operation brings the liquid level of the electrolytic bath in the anode chamber 5 and the liquid level of the electrolytic bath in the cathode chamber 7 back to the equal level, the solenoid valves 56, 57 are closed and the solenoid valves 51, 52, 53, 54 are opened (See FIG. 2) and thereby the electrolysis is restarted.

When the cathode chamber 7 is increased in pressure, or the anode chamber 5 is decreased in pressure, in the middle of electrolysis by the hydrogen gas line being clogged resulting from accumulation of droplets of the electrolytic bath 3 and the like, so that the anode chamber 5 is higher in the liquid level of the electrolytic bath 3 than the cathode chamber 7, the abnormal liquid levels 3A, 3B of the electrolytic bath are detected by the level probes 8, 9.

Figure 5:
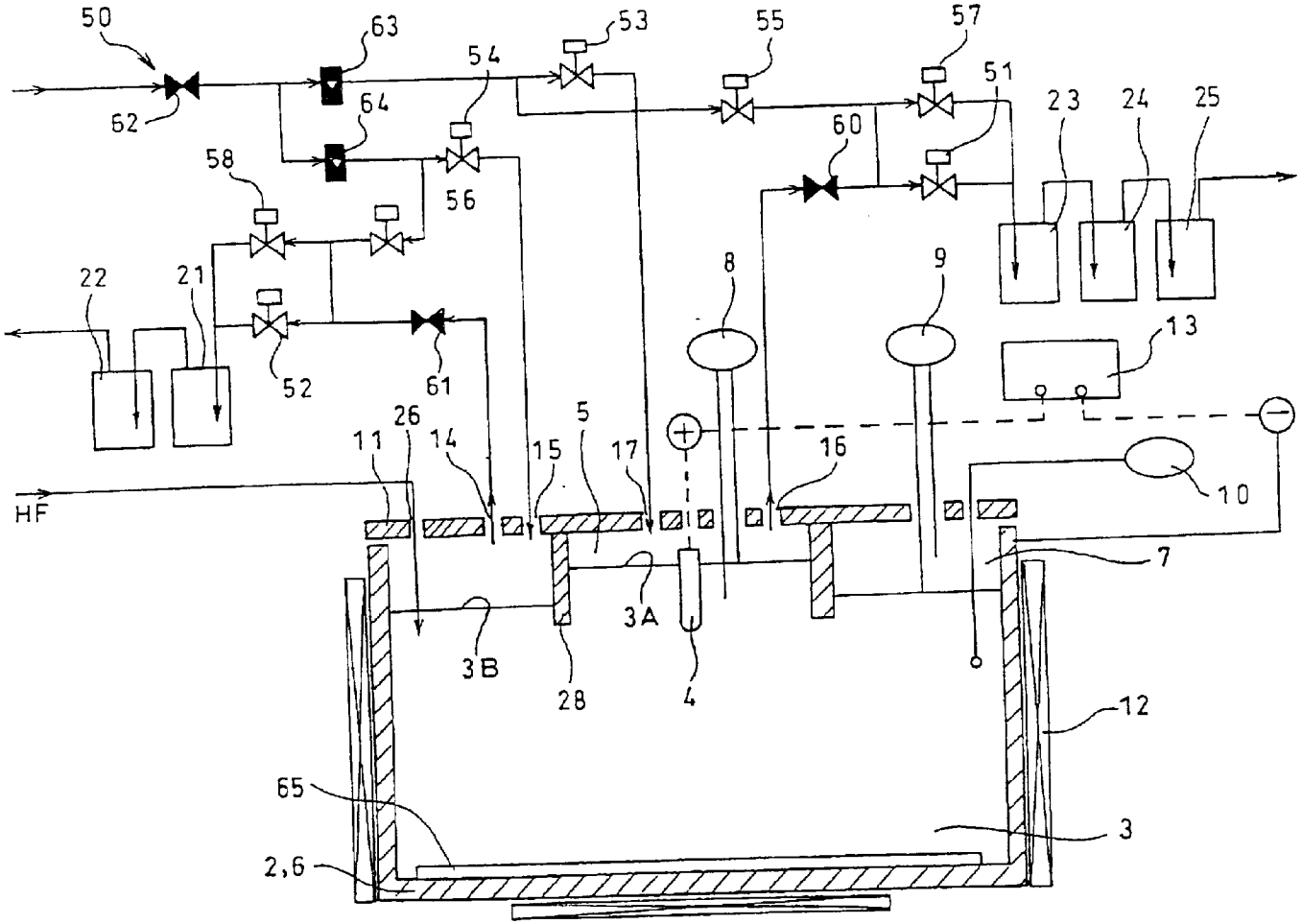
FIG. 5 is an illustration showing the state that the liquid level 3A rises and the liquid level 3B falls; the abnormal liquid levels are detected by the level probe 8 or 9; and the solenoid valves 51, 52, 53, 54 are closed.

Then, under control of the signals from the level probe 8 or 9, the solenoid valves 51, 52, 53, 54 are closed, as shown in FIG. 5, and thereby the gas flows through the gas lines are stopped. In parallel with this, under control of the signals from the control means, the power source 13 of the electrolysis is halted and thereby the electrolysis is halted.

Figure 6:
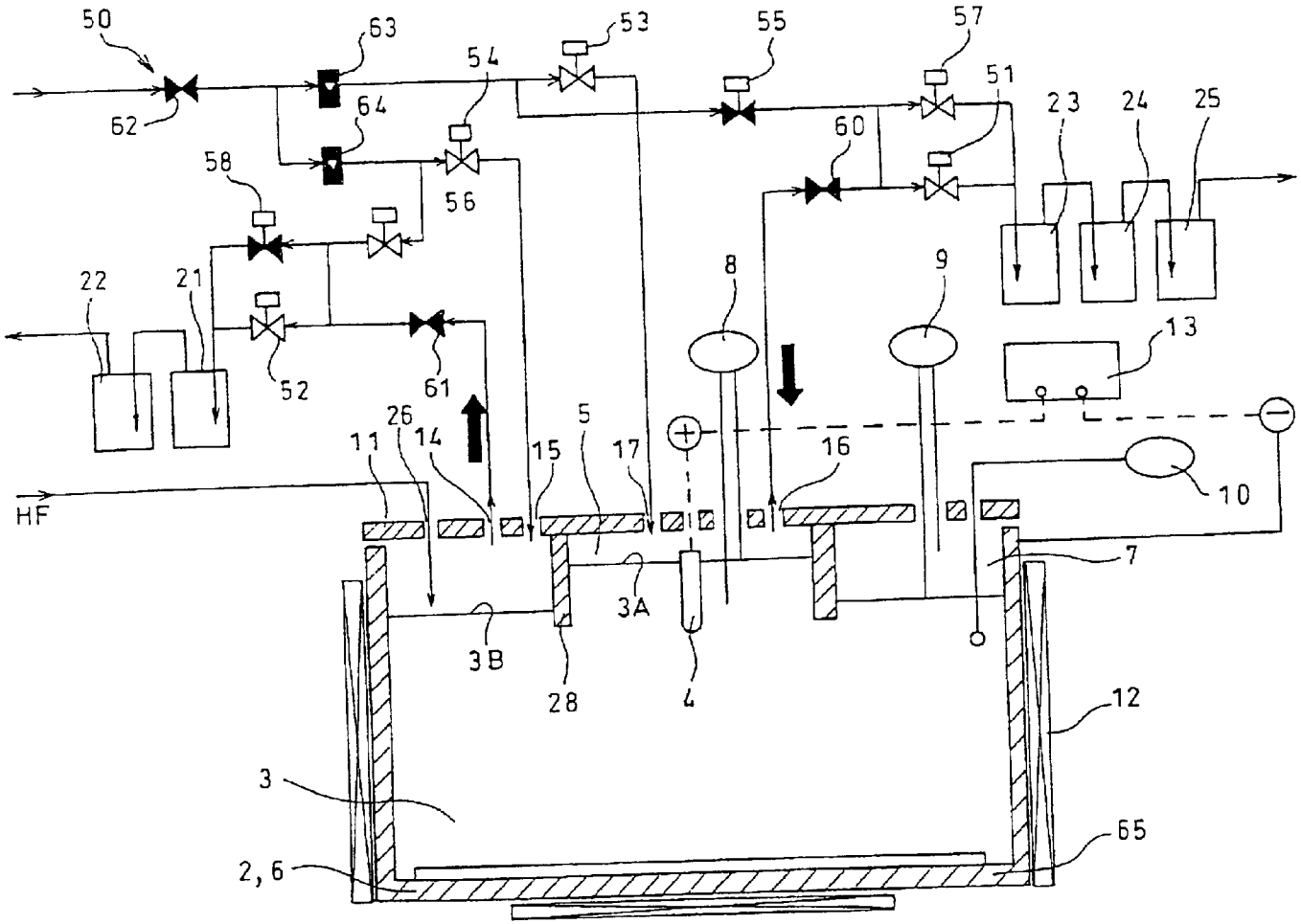
FIG. 6 is an illustration showing the state that following the state of FIG. 5, a solenoid valve 55 to introduce the gas into the anode chamber and a solenoid valve 58 to discharge the gas of the cathode chamber are opened to eliminate the abnormal liquid level.

Sequentially, as shown in FIG. 6, the solenoid valve 58 is opened for a short time, so that the hydrogen gas in the interior of the cathode chamber 7 is discharged from the hydrogen gas generation port 14 provided in the upper lid 11 of the electrolytic cell 2. In parallel with this, the solenoid valve 55 is also opened for a short time, so that purge gas is introduced into the anode chamber 5 through the fluorine gas generation port 16. After this operation brings the liquid level of the anode chamber 5 and the liquid level of the cathode chamber 7 back to the equal level, the solenoid valves 55, 58 are closed and the solenoid valves 51, 52, 53, 54 are opened (See FIG. 2) and thereby the electrolysis is restarted.

As mentioned above, the solenoid valves 51, 52, 53, 54, 55, 56, 57, 58 are properly opened and closed under control of the signals of the liquid level detection signals from the level probes 8, 9 provided in the anode chamber 5 and the cathode chamber 7, so as to make such a control that the liquid level of the electrolytic bath 3 can always be within a certain range between the upper limit and the lower limit of the level probes 8, 9. This can provide a stable electrolysis and thus a stable supply of the fluorine gas.

Next, reference will be made to the way of producing the fluorine gas by use of the fluorine gas generating apparatus according to this embodiment.

First, a metal such as a stainless steel is worked into a cylindrical shape as shown in FIG. 1 to form the electrolytic cell 2. The gas generation ports 14, 16, the purge gas inlet and outlet ports 15, 17 and a HF feed port 26 are formed in the upper lid 11. The upper lid 11 is provided, at a center portion thereof on the electrolytic cell 2 side, with the partition wall 28 to separate the interior of the electrolytic cell 2 into the anode chamber 5 and the cathode chamber 7. The partition wall 28 may be formed to be integral with the upper lid 11 or may alternatively be attached thereto by welding or equivalent. Also, the Ni anode 4 is attached to the center of the lid 11. The pair of long-and-short level probes 8, 9 are attached to the anode chamber 5 and the cathode chamber 7, respectively. Further, the thermocouple 10 for temperature regulation of the electrolytic bath 3 is attached to the cathode chamber. Powdered acid potassium fluoride (KF.HF) which turns into the electrolytic bath by heating and melting is filled in the electrolytic cell. Then, after a seal material is sandwiched between the upper lid 11 and the electrolytic cell 2, the electrolytic cell 2 is sealed off by the upper lid 11 via the threaded engagement. Then, with the HF supply line heated to about 40° C., a prescribed amount of hydrogen fluoride anhydride gas is bubbled in the previously filled KF.HF from the HF feed port 26, to obtain the melted KF.2HF bath. Further, the heater 12 and the gas lines 50 including the heat insulating material and pressurization or depressurization means are disposed in place and accommodated in the cabinet 1. As the electrolysis proceeds, the raw material of HF decreases. There are two HF feeding ways: a batch feeding type and a continuous feeding type. Industrially, the latter type is mainly adopted. In the batch feeding type, reduction of weight of the electrolytic bath 3 is detected and the HF is re-supplied by the extent corresponding to that reduction. On the other hand, in the continuous feeding type, the liquid level drop resulting from the HF temperature drop of the electrolytic bath 3 is detected by a liquid level probe, not shown, attached to the cathode chamber 7 and then a solenoid valve, not shown, (which does not detect liquid level fluctuation of the cathode chamber 7 resulting from pressure fluctuation) attached to the HF supply line is opened to automatically supply the HF from the upper lid 11. As a result of this, the liquid level of the electrolytic bath 3 gradually rises, and when the liquid level probe contacts with the gradually rising liquid level of the electrolytic bath, it sends out signals under which the solenoid valve is automatically closed. In the continuous feeding, this process is repeatedly performed. The liquid level probe, not shown, placed in the cathode chamber 7 is electrically independent of the liquid level probe 9 placed in the cathode chamber 7 and is so constructed that when the differential pressure fluctuation is caused, particularly even when the hydrogen gas pressure in the cathode chamber 7 increases, as shown in FIG. 6, it can work to halt the power source 13 and simultaneously close the solenoid valves of the HF supply line to halt the HF supply.

The interior of the electrolytic cell 2 is heated to approximately 90° C. by the heater 12, with the result that the KF.2HF bath is melted so that it can be electrolyzed. The fluorine gas and the hydrogen gas produced by the electrolysis fill in the anode chamber 5 and the cathode chamber 7, then these gases being discharged from the gas generation ports 16, 14 by the gas introduced via the pressure keeping means 50 in such a fashion as to be extruded therefrom. The fluorine gas discharged from the anode chamber 5 passes through the blank tower 23, the absorption tower 24 and the filter tower 25 to eliminate the particles from the fluorine gas and then are supplied to the pressurization or depressurization system in the form of high purity fluorine gas.

During this process, the liquid levels of the electrolytic bath 3 in the anode chamber 5 and the cathode chamber 7 are detected by the level probes 8, 9. When the abnormal liquid level is detected, the solenoid valves 51, 52, 53, 54, 55, 56, 57, 58 are opened or closed accordingly, to control the liquid level in the electrolytic cell 2 so that it can be always within a certain level, as mentioned above. This can permit the stable electrolysis to proceed continuously, thus enabling the high purity fluorine gas to be supplied stably.

Figure 7:
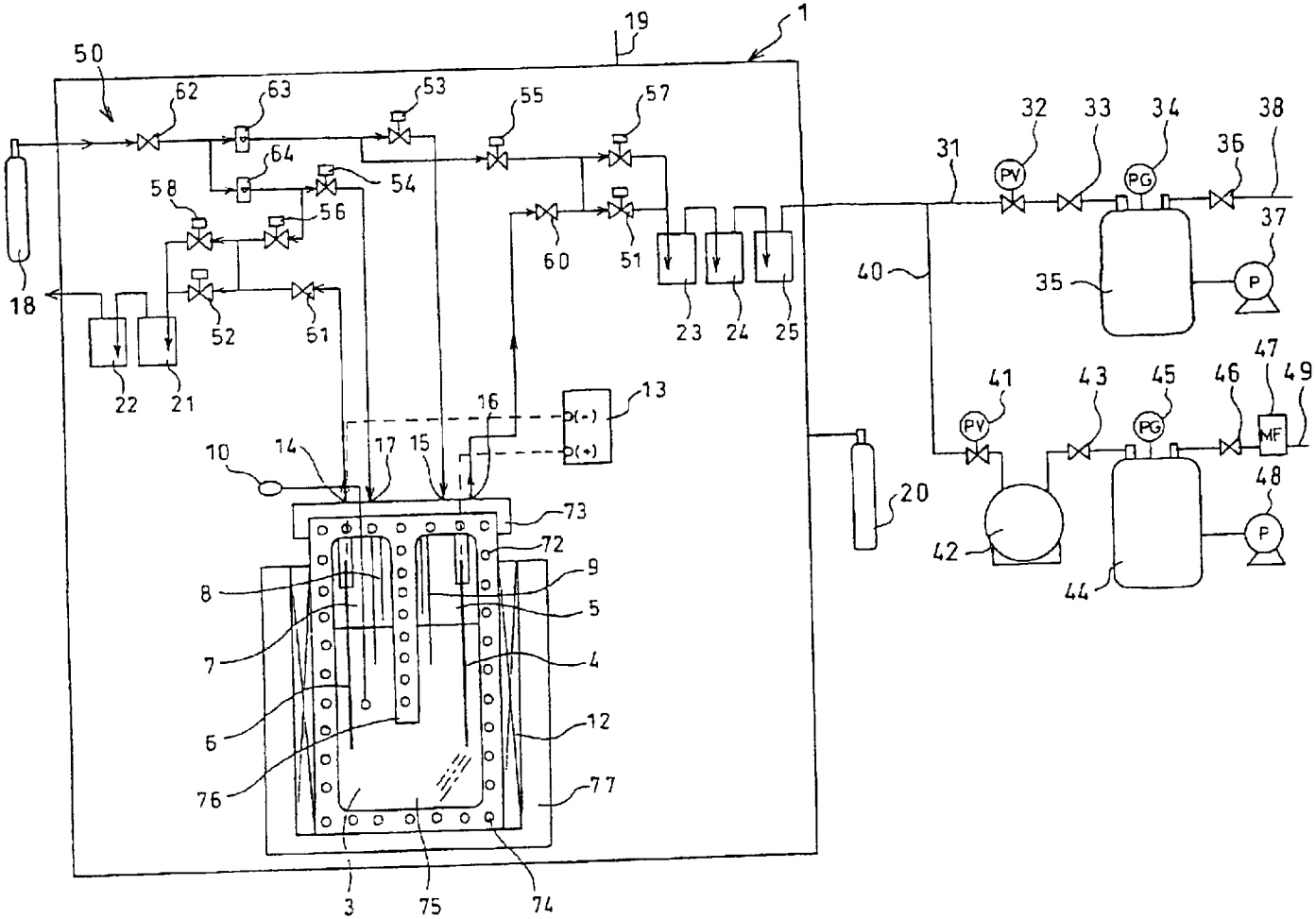
FIG. 7 is a schematic view showing another fluorine gas generating apparatus of the present invention.
Figure 8:
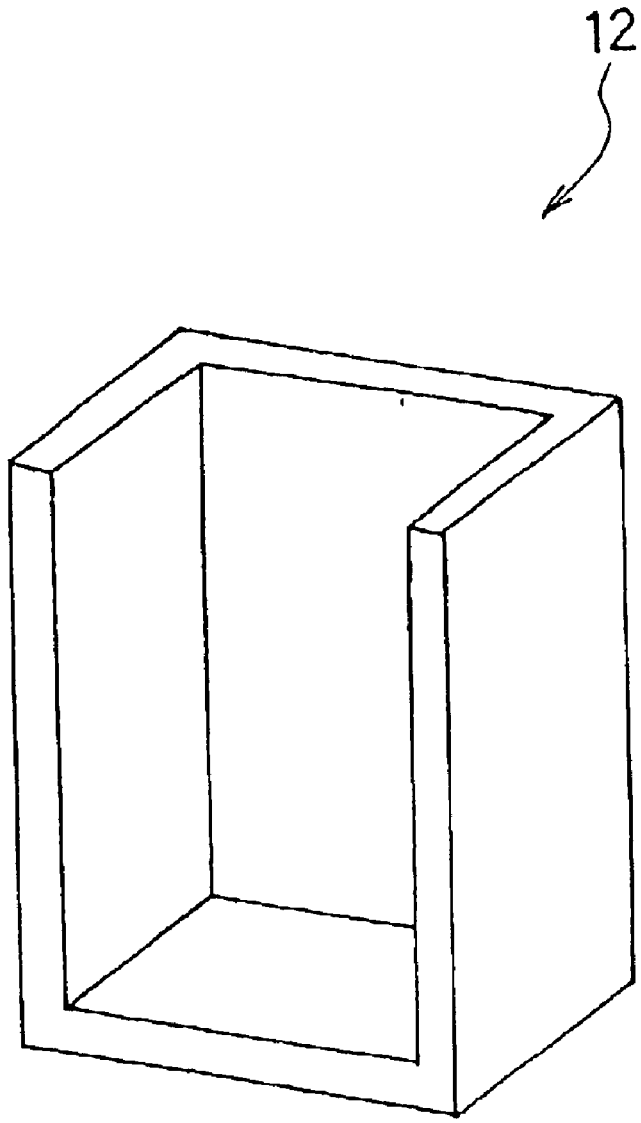
FIG. 8 is a perspective view showing an example of a configuration of a heater used in the fluorine gas generating apparatus according to the embodiment shown in FIG. 7.
Figure 9:
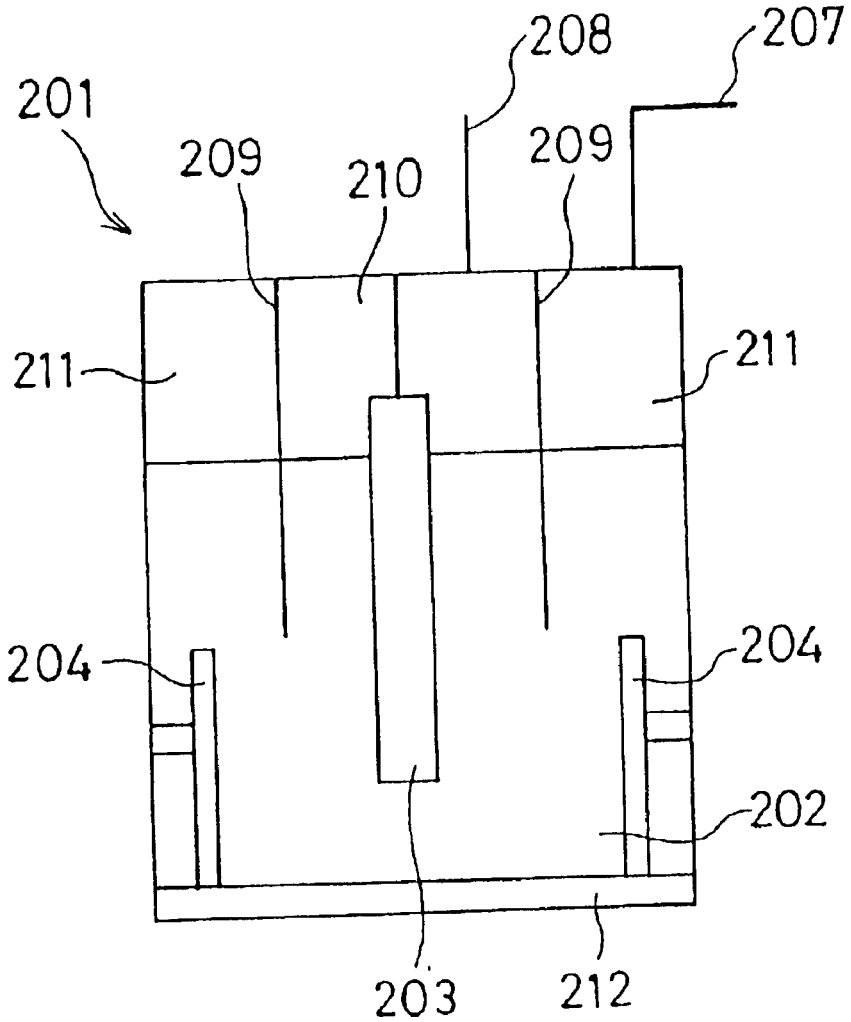
FIG. 9 is a schematic view of a conventional fluorine gas generating apparatus.

Referring now to FIGS. 7 and 8, reference will be made to another embodiment of the fluorine gas generating apparatus according to the present invention. Like reference characters are labeled to the corresponding parts to those in FIGS. 1 to 6 and detailed description thereon is omitted.

An electrolytic cell 72 used in a fluorine gas generating apparatus according to this embodiment is formed in a rectangular cylindrical shape from fluoropolymer, such as polytetrafluoroethylene resin, having corrosion resistance against fluorine gas and heat resistance fully endurable against the temperature of 70–90° C. in the electrolysis. At least one side of the electrolytic cell 72 is formed of any of tetrafluoroethylene/perfluoroalkyl vinyl ether copolymer, trimethylpentene resin and equivalent. The electrolytic cell 72 is formed by hollowing a fluoropolymer block so as to have the illustrated configuration of the electrolytic cell 72 having a handle 73 and a partition wall 76 and containing the electrolytic bath 3, as shown in FIG. 7. The electrolytic cell is integrally formed into the configuration as shown in FIG. 7. Preferably, the electrolytic cell 72 has the configuration in which an opening is formed at the least one side surface. A transparent resin plate 75 of tetrafluoroethylene/perfluoroalkyl vinyl ether copolymer, trimethylpentene resin and equivalent is secured to the opening by threaded engagement of screws with a number of threaded holes formed in the opening, so as to hermetically seal up the electrolytic cell 72. As a result of this, a visual inspection of the interior of the electrolytic cell 72 can be made. For improvement in hermetical seal, it is preferable that a seal material of fluoropolymer is sandwiched between the body of the electrolytic cell 72 and the plate 75. Additionally, a metal frame of stainless steel and the like corresponding in size to the plate 75 of the transparent resin comprising tetrafluoroethylene/perfluoroalkyl vinyl ether copolymer, trimethylpentene resin and equivalent is put on the seal material and then is screwed from the above. This can provide improved hermitical seal between the electrolytic cell 72 and the plate 75 of the transparent resin comprising tetrafluoroethylene/perfluoroalkyl vinyl ether copolymer, trimethylpentene resin and equivalent abutted with the side of the electrolytic cell 72. Also, as a result of a part of the side walls of electrolytic cell 72 being freely opened and closed, replacement of the electrodes 4, 6 and the mixed molten salt that turns into the electrolytic bath 3 can be facilitated.

The electrolytic cell 72 is separated into the anode chamber 5 and the cathode chamber 7 by a partition wall 76 comprising the same resin as the electrolytic cell 72, and the electrodes comprising Ni are disposed in those chambers as the anode 4 and the cathode 6, respectively. The electrolytic cell 72 is provided, on its top surface, with the inlet and outlet ports 15, 17 for the purge gas from the pressure keeping means 50 via which the interior of the anode chamber 5 and the interior of the cathode chamber 17 are pressurized, the generation port 16 for the fluorine gas generated from the anode chamber 5, and the generation port 14 for the hydrogen gas generated from the cathode chamber 7. The electrolytic cell 72 is provided with the temperature control means for heating the interior of the electrolytic cell 72. The temperature control means comprises the heater 12 provided around the body of the electrolytic cell 72 so as to be in close contact with it, a temperature control (not shown) to make a general PID control which is connected to the heater 12, and the thermocouple 10 disposed in the cathode chamber 7. The temperature control means serves to make a temperature control of the interior of the electrolytic cell 2. The heat insulating material 77 is provided around the heater 12. The heater 12 may take any form, including a ribbon type one and a heating element, and no particular limitation is imposed on the form of the heater 12. Preferably, the heater has, for example, a box-like form as shown in FIG. 8. This permits the electrolytic cell 72 to be housed in the box-like heater, and as such can permit precise temperature regulation of the interior of the electrolytic cell 72.

In the fluorine gas generating apparatus according to this embodiment, Ni is used for both of the anode 4 and the cathode 6. The use of Ni for the anode 4 can prevent the production of $CF_4$ by reaction with carbon and fluorine gas, and as such can permit the production of high purity fluorine gas. In addition, this can also prevent the emergence of the anode effect that is a polarization phenomenon that is typical of the carbon electrode. Further, the use of Ni for the cathode 6 can permit the surface energy to be reduced by hydride and oxide generated on the surface of Ni, as compared with the iron cathode. This permits the bubbles of the hydrogen gas generated to become so large that the mixture with the fluorine gas can be prevented. Further, when the anode 4 and the cathode 6 take, for example, a bored electrode form or an expanded metal electrode form, the mixture of the fluorine gas and the hydrogen gas can be suppressed further. This can permit the distance between the anode and the cathode to be reduced, and as such can permit the electrolytic cell to be reduced in size.

In the fluorine gas generating apparatus according to this embodiment, the electrolytic cell 72 is formed by hollowing a fluoropolymer block so as to have the illustrated configuration of the electrolytic cell 72, first. The electrolytic cell 72 thus formed has the handle 73 and the electrolytic cell 72 having an opening at one side surface thereof and having the partition wall 76 at around a center portion thereof to separate the interior of the electrolytic cell 72 into two spaces, as shown in FIG. 7. Then, the gas generation ports 14, 16 and the purge gas inlet and outlet ports 15, 17 are provided in the top portion of the electrolytic cell 72, and the Ni anode 4 and the Ni cathode 6 are attached to the top portion of the electrolytic cell 72. Also, a pair of long-and-short level probes 8, 9 to detect the liquid level of the electrolytic bath are attached to the chambers 5, 7, respectively. Then, the powdered KF.HF are filled in the electrolytic cell 72. Then, a number of threaded holes 74 are formed in the side surface at the opening. Thereafter, the transparent resin plate 75 of tetrafluoroethylene/perfluoroalkyl vinyl ether copolymer, trimethylpentene resin and equivalent is threadedly engaged with the opening, with the seal material sandwiched therebetween. Further, the thermocouple 10 for temperature regulation of the electrolytic bath 3 is attached to the cathode chamber 7. Thereafter, a prescribed amount of hydrogen fluoride anhydride is bubbled to prepare the electrolytic bath 3. Then, the heater 12, the heat insulating material 77 and the gas lines such as the pressure keeping means 50 are disposed in place and accommodated in the cabinet.

Then, the interior of the electrolytic cell 72 is heated to approximately 90° C. by the heater 12, with the result that the KF.2HF mixed salt is melted so that it can be electrolyzed. The fluorine gas and the hydrogen gas produced by the electrolysis fill in the anode chamber 5 and the cathode chamber 7, then these gases being discharged from the gas generation ports 16, 14 by the gas introduced via the pressure keeping means 50 in such a fashion as to be extruded therefrom. After passing through the blank tower 23, the absorption tower 24 and the filter tower 25, the fluorine gas discharged from the anode chamber 5 is supplied in the form of high purity fluorine gas with the particles eliminated therefrom.

During this process, the liquid levels of the electrolytic bath 3 in the anode chamber 5 and the cathode chamber 7 are detected by the level probes 8, 9. When the abnormal liquid level is detected, the solenoid valves 51, 52, 53, 54, 55, 56, 57, 58 are opened or closed accordingly, to control the liquid level in the electrolytic cell 72 so that it can be always within a certain level, as mentioned above. This can permit the stable electrolysis to proceed continuously, thus enabling the high purity fluorine gas to be supplied stably.

When the electrolytic bath 3 is electrolyzed for a long time, it is gradually suspended due to nickel fluoride ($NiF_2$) of the sludge generated at the electrolysis. This suspension can be visually inspected from the transparent plate 75 of the electrolytic cell 72. As accumulation of $NiF_2$ increases, resistance of the electrolytic bath 3 increases and it gradually becomes hard to proceed with the electrolysis. At that time, replacement of the electrolytic bath 3 is made. Also, when the Ni electrode is considerably consumed, the replacement of the electrode is made.

The high purity fluorine gas thus generated is controlled in pressure via the pressurization line 40 or the depressurization line 31 located downstream in the same manner as in FIG. 1, as shown in FIG. 7, and then is stored in the buffer tank 35 and the like. This enables a required amount of fluorine gas to be supplied from the supply ports 38, 49 as needed, and as such can allow the fluorine gas generating apparatus to be set in the semiconductor factory and the like on an on-site basis. This can permit the fluorine gas to be easily used for the cleaning of the semiconductor products and the like. Also, since the fluorine gas generating apparatus according to the present invention is so small in scale that it can be used on an on-site basis, the installation site and location is not limited. Accordingly, the apparatus of the present invention can be used for surface treatments of various types of materials as well as for production processes of semiconductors. For example, the apparatus of the present invention can be applied to surface treatments of paper and textiles which are to be modified so as to provide water repellent property and hydrophilic property for them.

Capability of Exploitation in Industry

The gas generating apparatus of the present invention can produce high purity fluorine gas stably. Also, the gas generating apparatus of the present invention can prevent leakage of electrolytic bath or solution from the electrolytic cell. Also, it can prevent leakage of fluorine gas produced. Further, since the gas generating apparatus of the present invention can provide the fluorine gas generating apparatus on an on-site basis, the need for the storage of the dangerous gas cylinder of fluorine gas can be eliminated, differently from the prior art. In view of these, the gas generating apparatus of the present invention can be used for surface treatments of various types of materials as well as for production fields of semiconductors.

What is claimed is:

1. A fluorine gas generating apparatus for generating fluorine gas of high purity by electrolysis of a mixed molten-salt comprising hydrogen fluoride, the fluorine gas generating apparatus comprising:

an electrolytic cell which is separated into an anode chamber and a cathode chamber by a partition wall;

a liquid level detecting means, which is provided in at least one of the anode chamber and the cathode chamber of the electrolytic cell, for detecting an upper level and a lower level of liquid level fluctuation of the molten-salt; and a pressure keeping means for supplying gas to the anode chamber and the cathode chamber, respectively, to keep an interior of the anode chamber and an interior of the cathode chamber at a certain pressure, wherein the pressure keeping means is provided with an automatic valve that is opened and closed based on detection results of the liquid level detecting mean, provided in at least one of the anode chamber and the cathode chamber of the electrolytic cell, for detecting an upper level and a lower level of liquid level fluctuation of the molten-salt, so as to supply or discharge the gas to and from the interior of the anode chamber and the interior of the cathode chamber.

2. The fluorine gas generating apparatus according to claim 1, wherein the mixed molten-salt comprising the hydrogen fluoride is KF—HF systems and there is provided temperature control means for adjusting temperature of the mixed molten-salt containing the hydrogen fluoride.

3. The fluorine gas generating apparatus according to claim 1, wherein the gas supplied by the pressure keeping means is a noble gas.

4. The fluorine gas generating apparatus according to claim 1, wherein an anode and a cathode disposed in the anode chamber and the cathode chamber respectively are formed of nickel.

5. The fluorine gas generating apparatus according to claim 1, wherein the electrolytic cell is formed of metal.

6. The fluorine gas generating apparatus according to claim 1, wherein the electrolytic cell is cylindrical in shape.

7. The fluorine gas generating apparatus according to claim 1, wherein the electrolytic cell is formed of metal and serves as a cathode.

8. The fluorine gas generating apparatus according to claim 1, wherein the electrolytic cell is formed, of metal; formed in a cylindrical shape; and serves as the cathode.

9. The fluorine gas generating apparatus according to claim 1, wherein the electrolytic cell is formed of a resin having corrosion resistance against the fluorine gas.

10. The fluorine gas generating apparatus according to claim 1, wherein the electrolytic cell is formed of a resin having corrosion resistance against the fluorine gas and is formed in a rectangular cylindrical shape.

11. The fluorine gas generating apparatus according to claim 1, wherein the electrolytic cell is formed of a resin having corrosion resistance against the fluorine gas and is formed in a rectangular cylindrical shape, and at least one side surface of the electrolytic cell is threadedly engaged with the electrolytic cell so as to be freely opened and closed.

12. The fluorine gas generating apparatus according to claim 1, wherein the electrolytic cell is formed of a resin having corrosion resistance against the fluorine gas and is formed in a rectangular cylindrical shape, and at least one side surface of the electrolytic cell is formed of a transparent resin and the remaining side surfaces are formed of fluoropolymer.

13. A fluorine gas generating apparatus for generating fluorine gas of high purity by electrolysis of a mixed molten-salt comprising hydrogen fluoride, the fluorine gas generating apparatus comprising an electrolytic cell which is separated into an anode chamber and a cathode chamber by a partition wall, pressure keeping means for supplying gas to the anode chamber and the cathode chamber, respectively, to keep an interior of the anode chamber and an interior of the cathode chamber at a certain pressure, a cabinet in which the electrolytic cell is contained and which can provide a controlled atmosphere, and a filter, contained in the cabinet, for filtering out particles in the fluorine gas generated from the electrolytic cell.

14. The fluorine gas generating apparatus according to claim 13, wherein at least one of the anode chamber and the cathode chamber of the electrolytic cell is provided with liquid level detecting means for detecting an upper level and a lower level of liquid level fluctuation of the molten-salt.

15. The fluorine gas generating apparatus according to claim 13, wherein the pressure keeping means is provided with a solenoid valve that is opened and closed based on detected results of the liquid level detecting mean, provided in at least one of the anode chamber and the cathode chamber of the electrolytic cell, for detecting an upper level and a lower level of liquid level fluctuation of the molten-salt, so as to supply or discharge the gas to and from the interior of the anode chamber and the interior of the cathode chamber.

16. The fluorine gas generating apparatus according to claim 13, wherein the mixed molten-salt comprising the hydrogen fluoride is KF—HF systems and there is provided temperature control means for adjusting temperature of the mixed molten-salt containing the hydrogen fluoride.

17. The fluorine gas generating apparatus according to claim 13, wherein the gas supplied by the pressure keeping means is a noble gas.

18. The fluorine gas generating apparatus according to claim 13, wherein an anode and a cathode disposed in the anode chamber and the cathode chamber respectively are formed of nickel.

19. The fluorine gas generating apparatus according to claim 13, wherein the electrolytic cell is formed of metal.

20. The fluorine gas generating apparatus according to claim 13, wherein the electrolytic cell is cylindrical in shape.

21. The fluorine gas generating apparatus according to claim 13, wherein the electrolytic cell is formed of metal and serves as a cathode.

22. The fluorine gas generating apparatus according to claim 13, wherein the electrolytic cell is formed of metal; formed in a cylindrical shape; and serves as the cathode.

23. The fluorine gas generating apparatus according to claim 13, wherein the electrolytic cell is formed of a resin having corrosion resistance against the fluorine gas.

24. The fluorine gas generating apparatus according to claim 13, wherein the electrolytic cell is formed of a resin having corrosion resistance against the fluorine gas and is formed in a rectangular cylindrical shape.

25. The fluorine gas generating apparatus according to claim 13, wherein the electrolytic cell is formed of a resin having corrosion resistance against the fluorine gas and is formed in a rectangular cylindrical shape, and at least one side surface of the electrolytic cell is threadedly engaged with the electrolytic cell so as to be freely opened and closed.

26. The fluorine gas generating apparatus according to claim 13, wherein the electrolytic cell is formed of a resin having corrosion resistance against the fluorine gas and is formed in a rectangular cylindrical shape, and at least one side surface of the electrolytic cell is formed of a transparent resin and the remaining side surfaces are formed of fluoropolymer.

27. The fluorine gas generating apparatus according to claim 13, having a gas line, the gas line comprising the gas passing through the filter is pressured or de-pressured, and there are provided a pressurization apparatus or a depressurization apparatus and storage means in the gas line.

* * * * *